US006591638B2

(12) United States Patent
Estes et al.

(10) Patent No.: US 6,591,638 B2
(45) Date of Patent: Jul. 15, 2003

(54) NON-AQUEOUS WASHING APPARATUS AND METHOD

(75) Inventors: Kurt A Estes, Lake Zurich, IL (US); Daniel C. Conrad, Stevensville, MI (US); Mark Bradley Kovich, St. Joseph, MI (US); Tremitchell L. Wright, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/027,431

(22) Filed: Dec. 20, 2001

(65) Prior Publication Data

US 2002/0056164 A1 May 16, 2002

Related U.S. Application Data

(62) Division of application No. 09/520,653, filed on Mar. 7, 2000, now Pat. No. 6,451,066, which is a division of application No. 09/038,054, filed on Mar. 11, 1998, now Pat. No. 6,045,588

(60) Provisional application No. 60/045,072, filed on Apr. 29, 1997.

(51) Int. Cl.[7] ..... D06F 43/02; D06F 43/08

(52) U.S. Cl. ..... 68/5; 68/17 R; 68/18 R

(58) Field of Search ..... 8/142, 158; 68/5 C, 68/6, 17 R, 18 R, 18 C, 205 R

(56) References Cited

U.S. PATENT DOCUMENTS 4,235,600 A 11/1980 Capella et al.
4,802,253 A 2/1989 Hagiwara et al.
4,912,793 A 4/1990 Hagiwara
5,056,174 A 10/1991 Hagiwara
5,304,253 A 4/1994 Grant
5,407,446 A 4/1995 Sando et al.
5,423,921 A 6/1995 Saal et al.
5,447,171 A 9/1995 Shibano
5,460,018 A 10/1995 Werner et al.
5,461,742 A * 10/1995 Pasad et al. ..... 68/5 C X
5,467,492 A 11/1995 Chao et al.
5,498,266 A 3/1996 Takagawa et al.
5,503,681 A 4/1996 Inada et al.
5,759,209 A 6/1998 Adler et al.

* cited by examiner

*Primary Examiner*—Philip Coe
(74) *Attorney, Agent, or Firm*—Stephen Krefman; Robert O. Rice; Thomas J. Roth

(57) ABSTRACT

Methods and apparatuses for washing fabric loads without water or using water only as a co-solvent are disclosed. One method of non-aqueous clothes washing includes the steps of disposing clothing in a wash container, delivering a wash liquor to the fabric load, the wash liquor comprising a substantially non-reactive, non-aqueous, non-oleophilic, apolar working fluid and at least one washing additive, applying mechanical energy to the clothing and wash liquor for a sufficient amount of time to provide fabric cleaning and, thereafter, substantially removing the wash liquor from the fabric load. The working fluid may be selected from the group consisting of perfluorocarbons, hydrofluoroethers, fluoronated hydrocarbons and fluoroinerts.

18 Claims, 14 Drawing Sheets

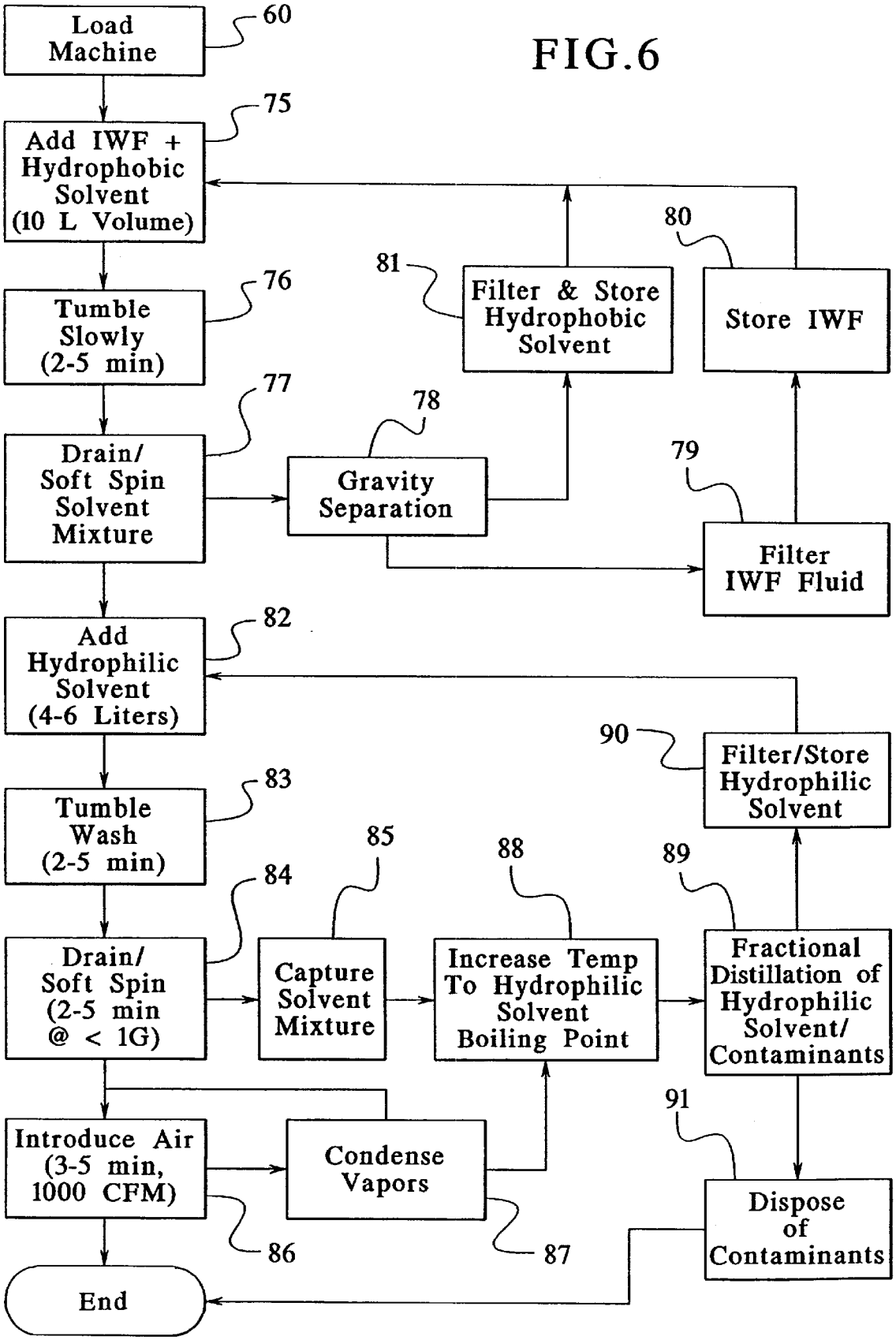
FIG.6
Load Machine
60
Add IWF + Hydrophobic Solvent (10 L Volume)
75
Tumble Slowly (2-5 min)
76
Drain/ Soft Spin Solvent Mixture
77
Gravity Separation
78
Filter & Store Hydrophobic Solvent
81
Store IWF
80
Filter IWF Fluid
79
Add Hydrophilic Solvent (4-6 Liters)
82
Filter/Store Hydrophilic Solvent
90
Tumble Wash (2-5 min)
83
Drain/ Soft Spin (2-5 min @ < 1G)
84
Capture Solvent Mixture
85
Increase Temp To Hydrophilic Solvent Boiling Point
88
Fractional Distillation of Hydrophilic Solvent/ Contaminants
89
Introduce Air (3-5 min, 1000 CFM)
86
Condense Vapors
87
Dispose of Contaminants
91
End

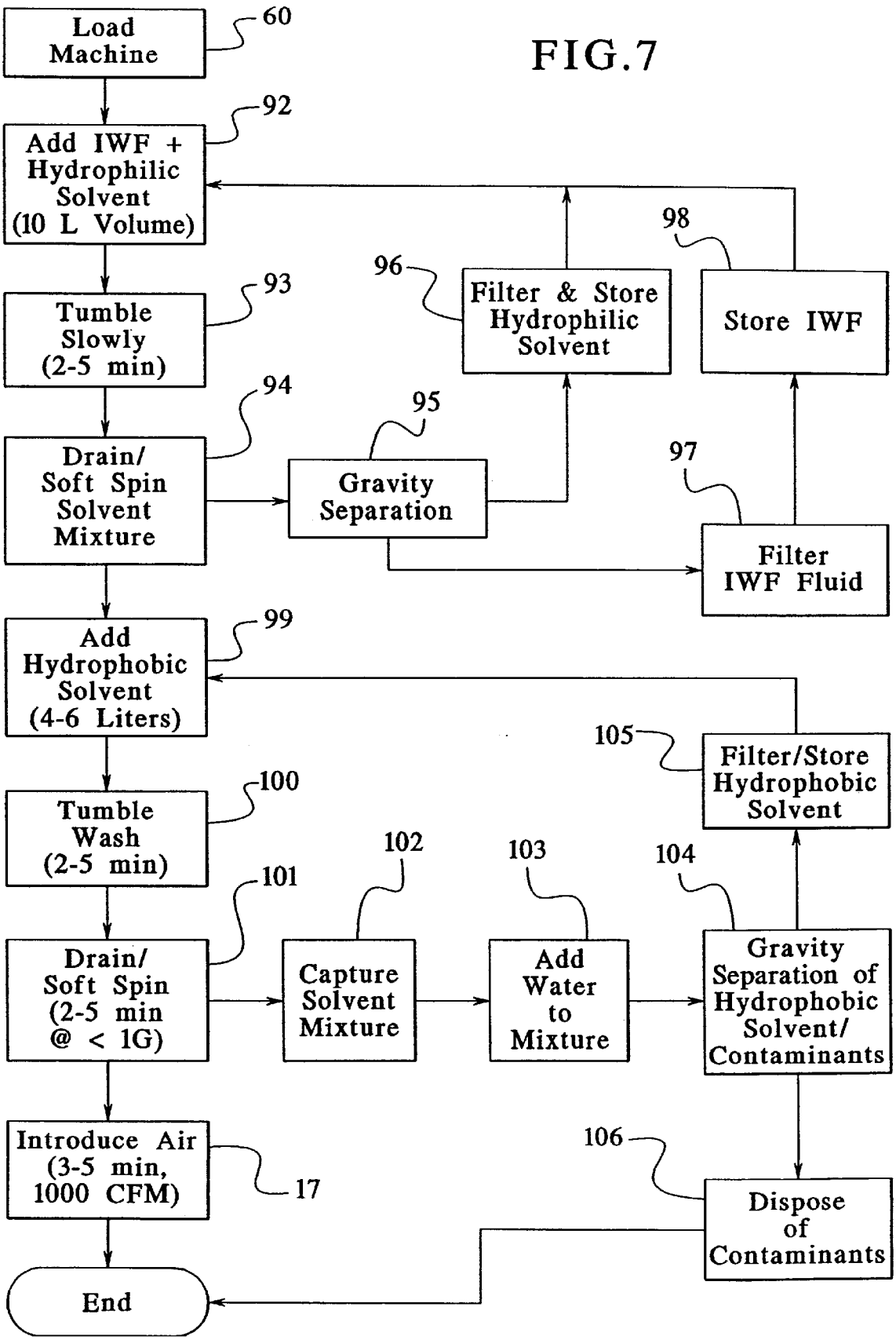
FIG.7
Load Machine
60
Add IWF + Hydrophilic Solvent (10 L Volume)
92
Tumble Slowly (2-5 min)
93
Drain/ Soft Spin Solvent Mixture
94
Gravity Separation
95
Filter & Store Hydrophilic Solvent
96
Store IWF
98
Filter IWF Fluid
97
Add Hydrophobic Solvent (4-6 Liters)
99
Tumble Wash (2-5 min)
100
Drain/ Soft Spin (2-5 min @ < 1G)
101
Capture Solvent Mixture
102
Add Water to Mixture
103
Gravity Separation of Hydrophobic Solvent/ Contaminants
104
Filter/Store Hydrophobic Solvent
105
Introduce Air (3-5 min, 1000 CFM)
17
Dispose of Contaminants
106
End

NON-AQUEOUS WASHING APPARATUS AND METHOD

RELATED APPLICATIONS DATA

The present application is a divisional application of U.S. application Ser. No. 09/520,653 filed on Mar. 7, 2000, now issued as U.S. Pat. No. 6,451,066; which is a divisional application of U.S. Application Ser. No. 09/038,054, filed Mar. 11, 1998, now issued as U.S. Pat. No. 6,045,588; which claims the benefit of the filing date of provisional application No. 60/045,072, filed Apr. 29, 1997; all disclosures of which are expressly incorporated by reference to the extent permissible by law.

BACKGROUND OF THE INVENTION

The present invention generally relates to apparatuses and methods employed in the home for laundering clothing and fabrics. More particularly, it relates to a new and improved method and apparatus for home laundering of a fabric load using a wash liquor comprising a multi-phase mixture of a substantially inert working fluid and at least one washing additive.

In the Specification and Claims, the terms "substantially non-reactive" or "substantially inert" when used to describe a component of a wash liquor or washing fluid, means a non-solvent, non-detersive fluid that under ordinary or normal washing conditions, e.g. at pressures of −10 to 50 atmospheres and temperatures of from about 10° to about 45° C., does not appreciably react with the fibers of the fabric load being cleaned, the stains and soils on the fabric load, or the washing additives combined with the component to form the wash liquor.

Home laundering of fabrics is usually performed in an automatic washing machine and occasionally by hand. These methods employ water as the major component of the washing fluid. Cleaning additives such as detergents, enzymes, bleaches and fabric softeners are added and mixed with the water at appropriate stages of the wash cycle to provide cleaning, whitening, softening and the like.

Although improvements in automatic washing machines and in cleaning agent formulations are steadily being made, as a general rule, conventional home laundering methods consume considerable amounts of water, energy and time. Water-based methods are not suitable for some natural fiber fabrics, such as silks, woolens and linens, so that whole classes of garments and fabrics cannot be home laundered, but instead, must be sent out for professional dry cleaning. During water washing, the clothes become saturated with water and some fibers swell and absorb water. After washing, the water must be removed from the clothes. Typically, this is performed in a two-step process including a hard spin cycle in the washer and a full drying cycle in an automatic dryer. The hard spin cycles tend to cause wrinkling which is not wanted. Even after spinning, drying cycle times are undesirably long.

Non-aqueous washing methods employed outside the home are known, but for various reasons, these methods are not suitable for home use. Generally, the non-aqueous washing methods to date employ substitute solvents in the washing fluid for the water used in home laundering.

Conventional dry cleaning methods have employed halogenated hydrocarbon solvents as a major component of a wash liquor. The most commonly used halogenated hydrocarbon solvents used for dry cleaning are perchloroethylene, 1,1,1-trichloroethane and CFC-113. These solvents are ozone depleting and their use is now controlled for environmental reasons. Moreover, many of these solvents are suspected carcinogens that would require the use of a nitrogen blanket. Accordingly, these dry cleaning solvents cannot be used in the home.

Alternative dry cleaning methods employed petroleum-based or Stoddard solvents in place of the halogenated hydrocarbon solvents. The petroleum-based solvents are inflammable and smog-producing. Accordingly, their commercial use is problematic and use of these materials in the home is out of the question. U.S. Pat. No. 5,498,266 describes a method using petroleum-based solvents wherein perfluorocarbon vapors are admixed with petroleum solvent vapors to remove the solvents from the fabrics and provide improvements in safety by reducing the likelihood of ignition or explosion of the vapors.

A further non-aqueous solvent based washing method employs liquid or supercritical carbon dioxide solvent as a washing liquid. As described in U.S. Pat. No. 5,467,492, highly pressurized vessels are required to perform this washing method. In accordance with these methods, pressures of about 500 to 1000 psi are required. Pressures of up to about 30 psi are approved for use in the home. The high pressure conditions employed in the carbon dioxide create safety hazards that make them unsuitable for residential use.

Various perfluorocarbon materials have been employed alone or in combination with cleaning additives for washing printed circuit boards and other electrical substrates, as described for example in U.S. Pat. No. 5,503,681. Spray cleaning of rigid substrates is very different from laundering soft fabric loads. Moreover, cleaning of electrical substrates is performed in high technology manufacturing facilities employing a multi-stage apparatus which is not readily adapted for home use.

Accordingly, to overcome the disadvantages of prior art home laundering methods, it is an object of the present invention to provide a new and improved method and apparatus for laundering a fabric load in the home employing a safe and effective, environmentally-friendly, nonaqueous wash liquor.

It is another object of the present invention to provide a new and improved apparatus for laundering a fabric load in the home, which is safe and effective for a broad range of fabric types, including natural fiber fabrics, such as woolens, linens and silks.

It is a further object of the present invention to provide a new and improved home laundering method and apparatus which consumes less water, time and energy than conventional water-based home laundering machines and methods.

It is still another object of the present invention to provide a new and improved dry to dry home laundering method and apparatus requiring less handling by the home user.

It is a further object of the present invention to provide a new and improved home dry to dry laundering method and apparatus which provides safe and effective fabric cleaning without introducing wrinkling.

SUMMARY OF THE INVENTION

In accordance with these and other objects, the present invention provides new and improved methods and apparatuses for laundering a fabric load in the home. In an embodiment, a method for laundering a fabric load is provided comprising the steps of:

disposing a fabric load in a wash container;

delivering a wash liquor to the fabric load, said wash liquor comprising a substantially non-reactive, nonaqueous, non-oleophilic, apolar working fluid and at least one washing additive;

applying mechanical energy to provide relative movement between said fabric load and said wash liquor for a time sufficient to provide fabric cleaning; and thereafter, substantially removing said wash liquor from said fabric load.

In a preferred embodiment, the working fluid is a liquid under washing conditions and has a density of greater than 1.0. The working fluid has a surface tension of less than or equal to 35 dynes/cm$^2$. The oil solvency of the working fluid should be greater than water without being oleophilic. Preferably, the working fluid has an oil solvency as measured by KB value of less than or equal to 30. The working fluid, also has a solubility in water of less than about 10%. The viscosity of the working fluid is less than the viscosity of water under ordinary washing conditions. The working fluid has a pH of from about 6.0 to about 8.0. Moreover, the working fluid has a vapor pressure less than the vapor pressure of water and has a flash point of greater than or equal to 145° C. The working fluid is substantially non-reactive under washing conditions with fabrics in the fabric load, with the additives present in the at least one washing additive and with oily soils and water soluble soils in the fabric load.

The working fluid is substantially non-swelling to natural fabrics present in the fabric load.

In an embodiment, the working fluid is a fluorine-containing compound selected from the group consisting of: perfluorocarbons, hydrofluoroethers, fluorinated hydrocarbons and fluoroinerts. Preferably, the working fluid comprises a compound having the formula:

$$(CF_3\ (CF_2)_n)_3\ N$$

wherein n is an integer of from 4 to 20.

In an embodiment, the at least one washing additive may be selected from the group consisting of: surfactants, enzymes, bleaches, ozone, ultraviolet light, hydrophobic solvents, hydrophilic solvents, deodorizers, fragrances, anti-static agents and anti-stain agents. Mixtures of any of these washing additives may be used. A number of washing additives may be individually mixed with working fluid and these mixtures may be sequentially contacted with the fabric load in any desired order.

In an embodiment relative movement between the fabric load and wash liquor is provided by moving the wash container in a manner which moves the fabric load with respect to the wash liquor. Relative movement may be provided by rotating the wash container about an axis, horizontal or otherwise, or by rotating the wash container about a vertical axis. Relative movement may be provided by nutating the wash container about a vertical axis. Relative movement may also be provided by pumping the wash liquor from the wash container and respraying the wash liquor into the wash container, as well as, by high pressure jetting of the wash liquor into the wash container. Vibratory shaking of the wash container may also be used to provide relative movement. Relative movement may be provided by exposing the wash container to ultra-sonic irradiation. Relative movement may also be provided by moving an agitator within the wash container relative to the wash container, or by reciprocally partially rotating the wash container with respect to stator blades mounted in the wash container.

A major advantage provided by the present invention is that it conserves time, water and energy.

Another advantage provided by the present invention is that a dryer is not required, saving cost, energy and floor space.

A further advantage provided by the present invention is that the preferred apparatus does not employ a hard spin cycle and eliminates the need for a dryer so that home laundering methods and apparatus are provided which are less noisy.

Still another advantage provided by the present invention is that less sorting, transferring and handling of the fabric load is required by the homeowner.

A further advantage provided by the present invention is that home laundering in accordance with the invention is substantially non-wrinkling so that no ironing is needed.

Still another advantage provided by the present invention is that because the wash liquor is non-wetting to the fabric load, no hard spin cycle is required, which in turn permits a washer to be provided which does not need a suspension system, thereby reducing cost, weight and energy.

A further advantage provided by the present invention is that effective cleaning of wool, silk and linen in the home is provided for the first time.

Other objects and advantages of the present invention will become apparent from the following detailed description of the Preferred Embodiments, taken in conjunction with the drawings, in which:

BRIEF DESCRIPTION OF THE DRAWINGS

The invention will now be described in more detail, with reference to the accompanying drawings, in which:

FIG. 6 is a flowchart illustrating another non-aqueous method of laundering a fabric load in accordance with the present invention;

FIG. 7 is a flowchart illustrating another non-aqueous method of laundering a fabric load in accordance with the present invention;

Figure 1:
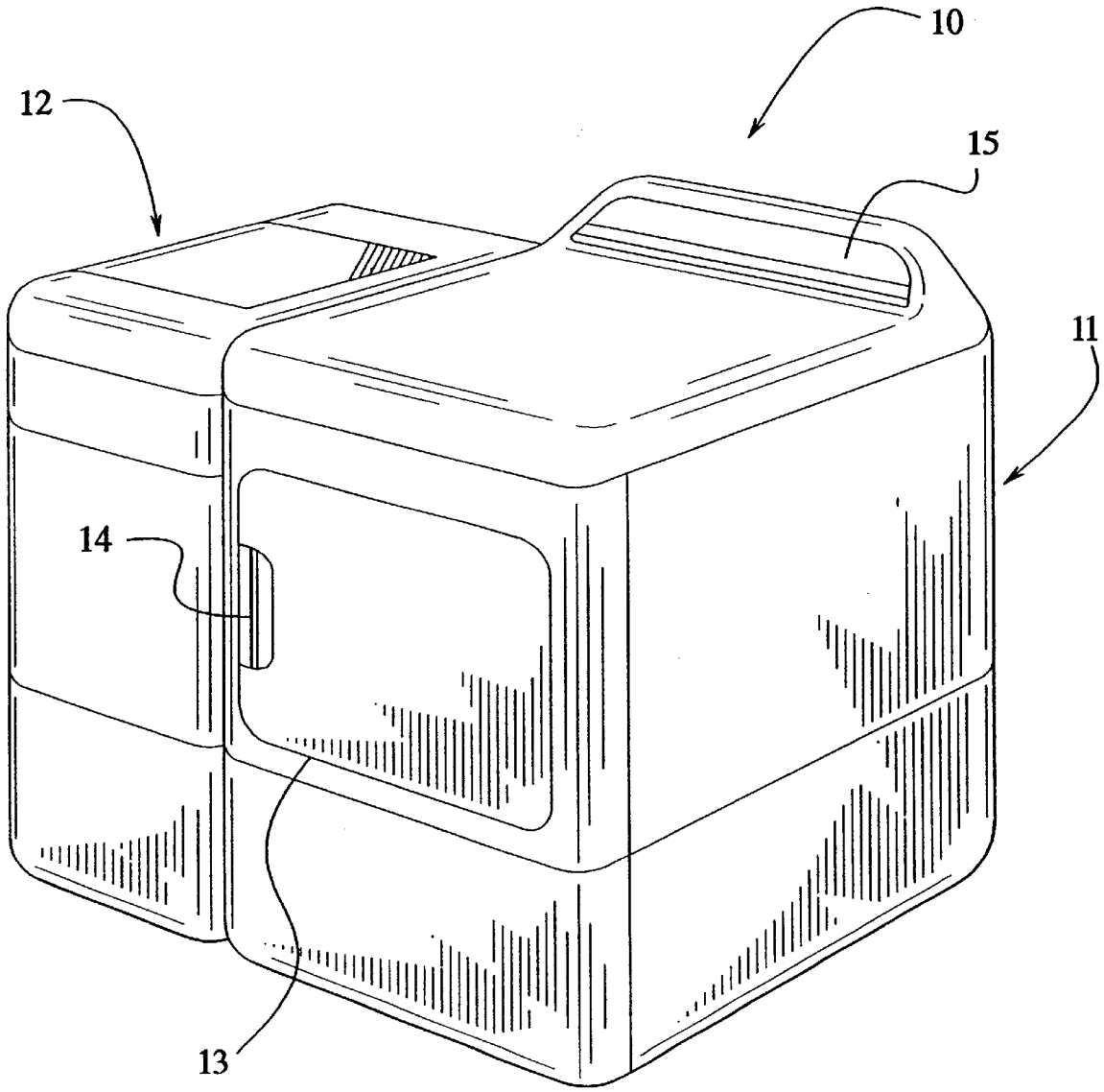
FIG. 1 is a perspective view of a combined washing apparatus and working fluid storage unit made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

An apparatus 10 for carrying out the method of laundering fabric loads in accordance with the present invention is illustrated. The apparatus 10 includes a washing apparatus 11 disposed adjacent to a working fluid storage unit 12. The washing apparatus 11 includes a front door 13, preferably with a handle 14, for placing a fabric load (not shown) in the washer 11. A control panel 15 is disposed along the top of the washer 11, along a back edge or other suitable location which makes it easy for the consumer to operate.

Figure 2:
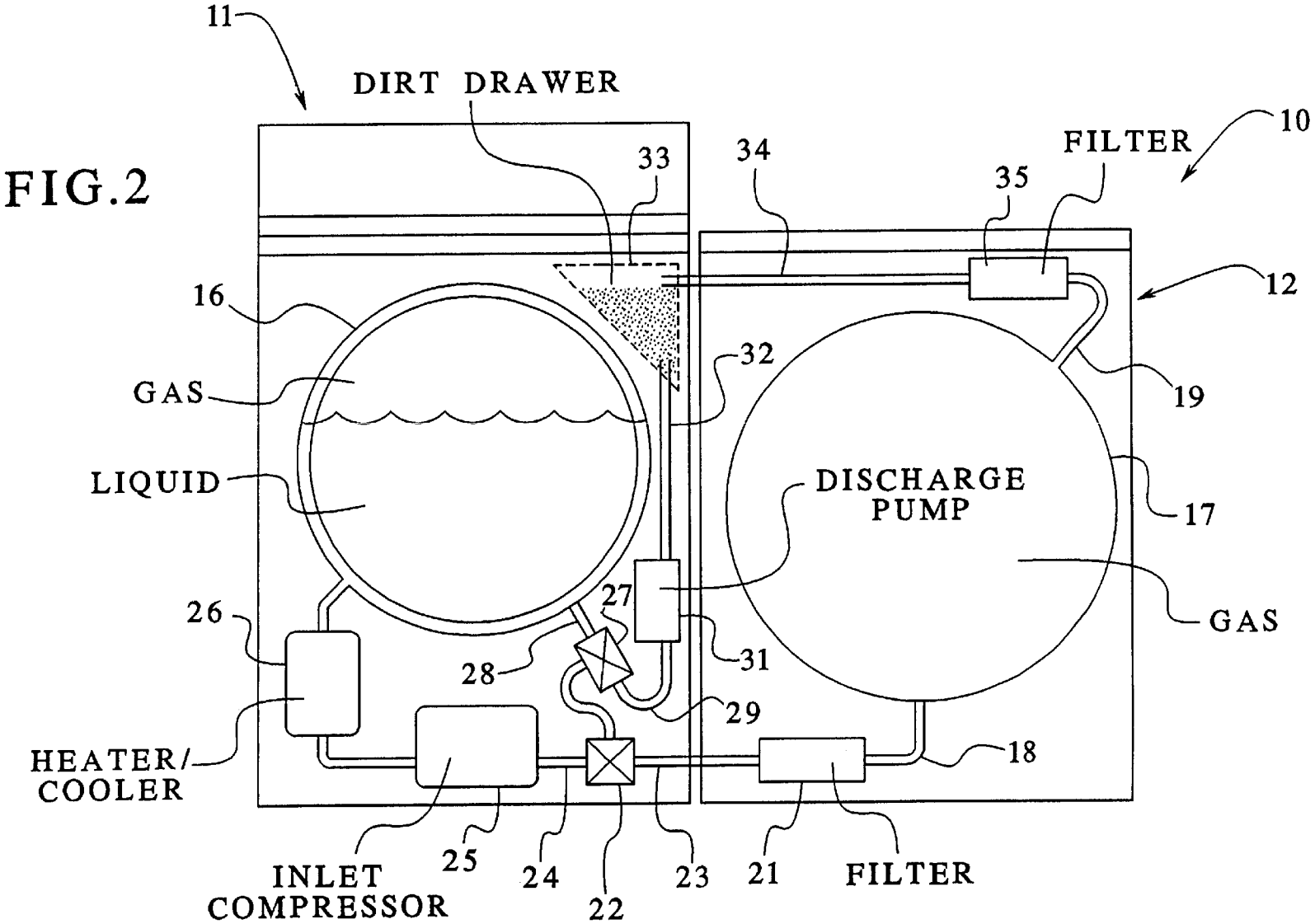
FIG. 2 is a schematic diagram of a washing apparatus and ideal working fluid storage unit made in accordance with the present invention.

As illustrated in FIG. 2, the washing apparatus 11 includes a centrally disposed wash chamber 16 which receives a fabric load (not shown). Working fluid is supplied to the wash chamber 16 from the working fluid storage unit 12. The storage unit 12 includes a generally centrally disposed tank 17 with an outlet conduit 18 and an inlet conduit 19. In the embodiment illustrated in FIG. 2, the working fluid is stored in the unit 12. Fluid then passes through the outlet 18, through a filter 21 and through a three-way valve 22. When fluid is to be charged into the wash chamber 16, the valve 22 is open between conduits 23 and 24 and fluid flows through the valve 22 into a compressor/condenser 25. The fluid is at least partially condensed in the compressor/condensor 25 before it passes through a heater/cooler unit 26 which, depending upon the working fluid, will most likely remove heat from the at least partially condensed gas stream so that the working fluid is converted into a liquid form before entry into the wash chamber 16.

The wash chamber 16 may be sealed and pressurized. The washing apparatus 11 may have means for pressurizing the wash chamber 16 to pressures of from about 5 atm to about 50 atm. When the wash liquor is dispensed from the dispensing means, the wash chamber may have a first pressure of between 1 atm and 50 atm. Further, the washing apparatus 11 may have means for reducing the pressure in the wash chamber 16 to a reduced second pressure less than the first pressure to remove any remaining wash liquor from the fabric load in vapor form.

The combination of the fabric (e.g. clothes) and the working fluid is then preferably agitated within the chamber 16 by way of an agitation means (not shown in FIG. 2) for a relatively short time period compared to currently-available automatic washers that use water as a working fluid. After the wash cycle, a three-way valve 27 is opened so that communication is established between conduits 28 and 29. A discharge pump 31, having already been activated, pumps the working fluid through the valve 27, through a conduit 32, and into a dirt container shown at 33. In the dirt container 33, the working fluid is vaporized, leaving any dirt particles entrained in the fluid in the dirt container 33 and permitting the gaseous working fluid to proceed through a conduit 34, through a filter 35, through the conduit 19 and back into the storage tank 17.

Figure 3:
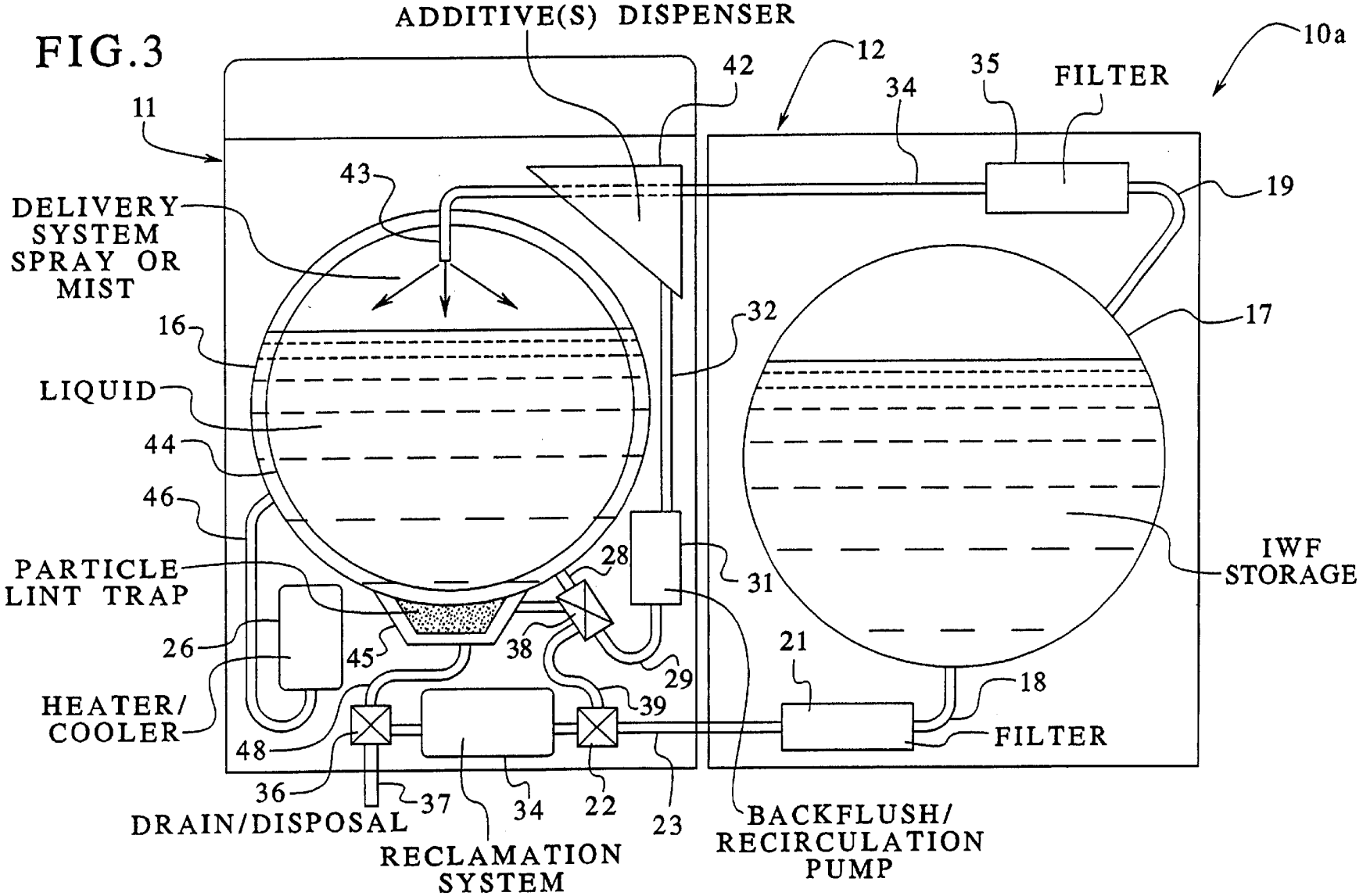
FIG. 3 is a schematic diagram of another embodiment of a washing apparatus and ideal working fluid storage unit made in accordance with the present invention.

In an alternative apparatus 10*a* illustrated in FIG. 3, a washing apparatus 11 is again disposed adjacent to a storage unit 12 which also includes a storage tank 17 for containing the working fluid. However, in the system 10*a*, the working fluid has a lower vapor pressure at operating pressures and temperature and, hence, is present within the storage tank 17 primarily as a liquid. To charge the wash chamber 16, fluid flows out of the storage tank 17, through the conduit 18 and through the filter 21. Again, a three-way valve 22 is disposed between the filter 21 and the wash chamber 16. In the embodiment 10*a* illustrated in FIG. 3, the three-way valve 22 provides communication between the conduit 23 and either a pump 48 for pumping the fluid through a three-way valve 36 and out a drain disposal 37 or, to a four-way valve shown at 38.

To charge the wash chamber 16 with working fluid, the four-way valve 38 is opened providing communication between conduits 39 and 28, fluid entering the chamber 16 through the conduit 28. Preferably, the fabric load (not shown) and working fluid are tumbled or agitated for a few minutes before additives are added to the chamber 16. Washing additives are added to the chamber 16 by way of a dispenser 42 and recirculated working fluid being pumped by the pump 31, through the conduit 32, through the dispenser 42 and out a spray or mist port 43.

When washing additives are to be delivered to the washing chamber 16, the four-way valve 38 is opened so that communication is established between the conduit 28 and the conduit 29. The back flush/recirculation pump 31 then pumps the fluid through the conduit 32, through the dispenser 42 and out the delivery port 43. Additives that have been disposed in the dispenser 42 are then entrained in the fluid being recirculated to the washing chamber 16 through the delivery port 43. A perforated basket is preferably disposed within the chamber 16 which permits particles and lint material from the fabric to flow through the perforated walls of the basket before being collected under the force of gravity in a particle/lint trap 45. A conduit 46 provides communication between the chamber 16 and a heater/cooler 26 for controlling the temperature of the working fluid within the chamber 16. The three-way valve 36, in a drain mode, establishes communication between a conduit 48 and the conduit 37. The working fluid is not normally drained from the washing chamber 16. Instead, it is normally recirculated by way of the pathway defined by the conduit 28, four-way valve 38, conduit 29, pump 31, conduit 32, dispenser 42, conduit 34, filter 35 and conduit 19.

FIGS. 4–12 and 15 illustrate various methods of washing fabrics in accordance with the present invention. For definitional purposes, a fluid that possesses no detersive properties similar to those properties found in conventional detergents, dry cleaning agents and liquefied carbon dioxide will hereinafter be referred to as an ideal working fluid (IWF). Examples of IWFs that can be utilized with the methods and apparatuses of the present invention include fluoroinerts, hydrofluoroethers, perfluorocarbons and similarly fluorinated hydrocarbons.

Compounds that provide a detersive action that is required to remove particulates, film soils and stains or that assist in the removal of particulates, film soils and stains will hereinafter be referred to as performance enhancers. These compounds include enzymes, organic and inorganic bleaches, ozone, ultraviolet light or radiation as well as polar and non-polar solvents.

A solvent that is different from the IWF in that its sole purpose is to provide detersive properties not met by the performance enhancers will hereinafter be referred to as a co-solvent. Co-solvents that may be used in the methods and with the apparatuses of the present invention include alcohols, ethers, glycols, esters, ketones and aldehydes. A mixture of these co-solvents with the IWF provides a system that is sufficiently stable for a fabric washing application.

Figure 4:
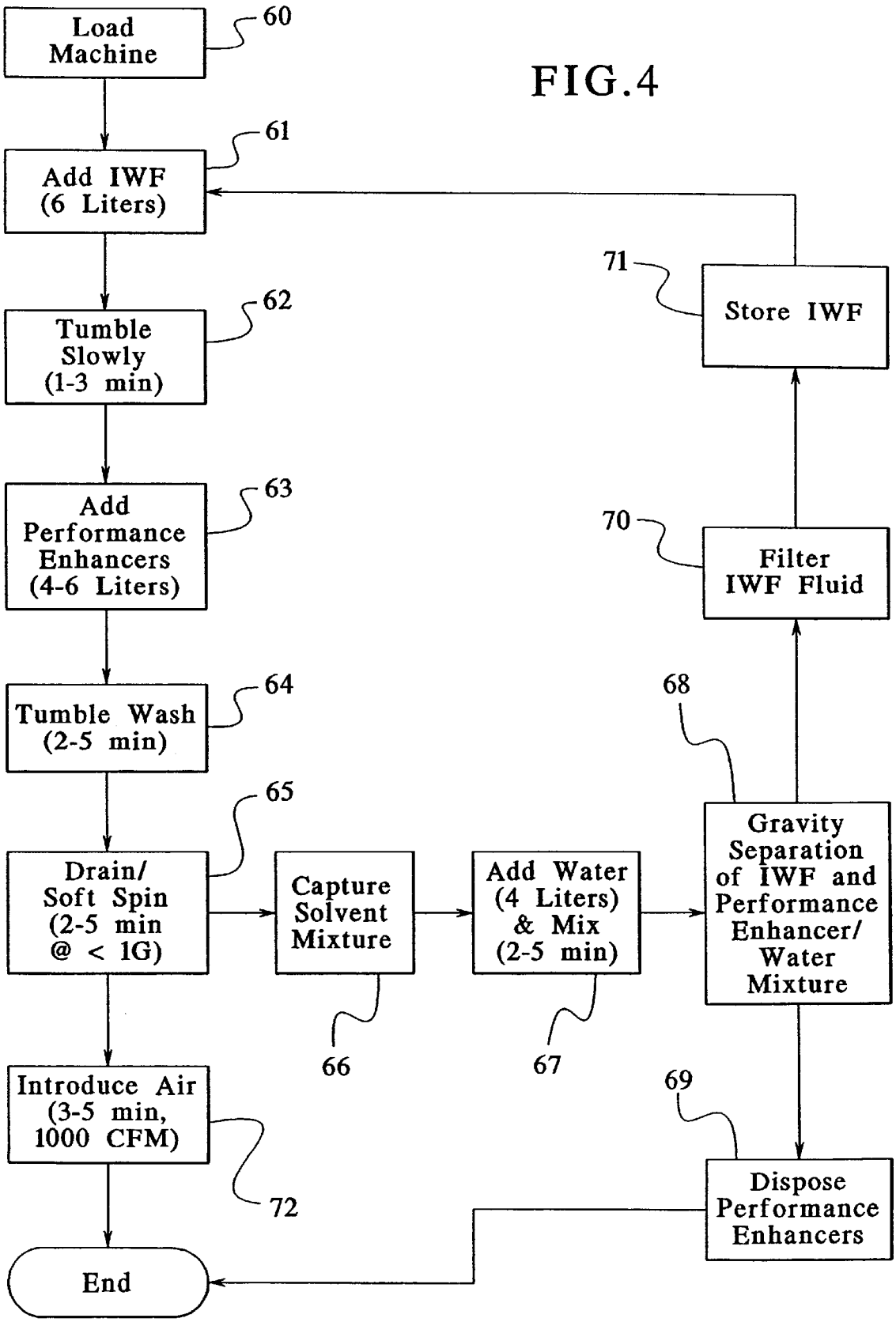
FIG. 4 is a flow chart illustrating a non-aqueous method of laundering a fabric load in accordance with the present invention.

Turning to FIG. 4, a first step 60 in one method of practicing the present invention is the loading of the washing chamber shown at 16 in FIGS. 2 and 3. The chamber 16 should preferably be capable of tumbling, agitating, nutating or otherwise applying mechanical energy to the combination of the fabrics and the IWF. A next step 61 includes the addition of the IWF in a relatively small amount compared to conventional washing systems. Specifically, an amount of approximately six (6) liters will be satisfactory for a normal size load of fabrics or clothes by conventional standards. The volume of IWF is less than a typical water volume for a conventional system since the surface tension and textile absorption of the IWF fluid is significantly less than that for water. Following the introduction of the IWF at step 61, the fabric (i.e. clothes) and IWF are tumbled slowly for a short period of time at step 62. Then, performance enhancers as discussed above, are added at step 63 to remove targeted contaminants in the fabrics. Mechanical energy is then applied to the system for a relatively short period compared to conventional aqueous systems at step 64.

In preferred embodiments, the agitation time ranges from about 2 minutes to about 5 minutes. In most embodiments and methods of the present invention, there is no need for the agitation time period to exceed more than 10 minutes. The combination of the draining of the IWF and a soft spin is performed at step 65. Because the IWF has a density greater than 1.0 g/ml and further because the IWF is not absorbed by the fabrics to a large degree, most of the IWF simply drains away from the fabric. However, the application of a soft spin to the fabrics by rotating the washing vessels shown at 16 in FIGS. 2 and 3 has been found effective to remove any excess IWF. The soft spin need not be as fast as a spinning cycle of a conventional washing machine that uses water. Instead, the rotational speed is similar to that of a conventional dryer, therefore eliminating the need for an elaborate suspension system as presently required by conventional washing machines.

The combination of the IWF and performance enhancers are captured at step 66. Water is added to this mixture at step 67 to separate the IWF from the performance enhancers. Water will have a greater affinity for the performance enhancers than the IWF. Further, the IWF is immiscible in water. Accordingly, a gravity separation technique can be employed at step 68 due to the difference in the specific gravity of water and the IWF. Water and the performance enhancers are disposed of at step 69 while the IWF is filtered at step 70 and stored at step 71 for the next cycle. Air is introduced to the fabric at step 72 to complete the drying of the garments without the need for an additional or separate drying apparatus.

Figure 5:
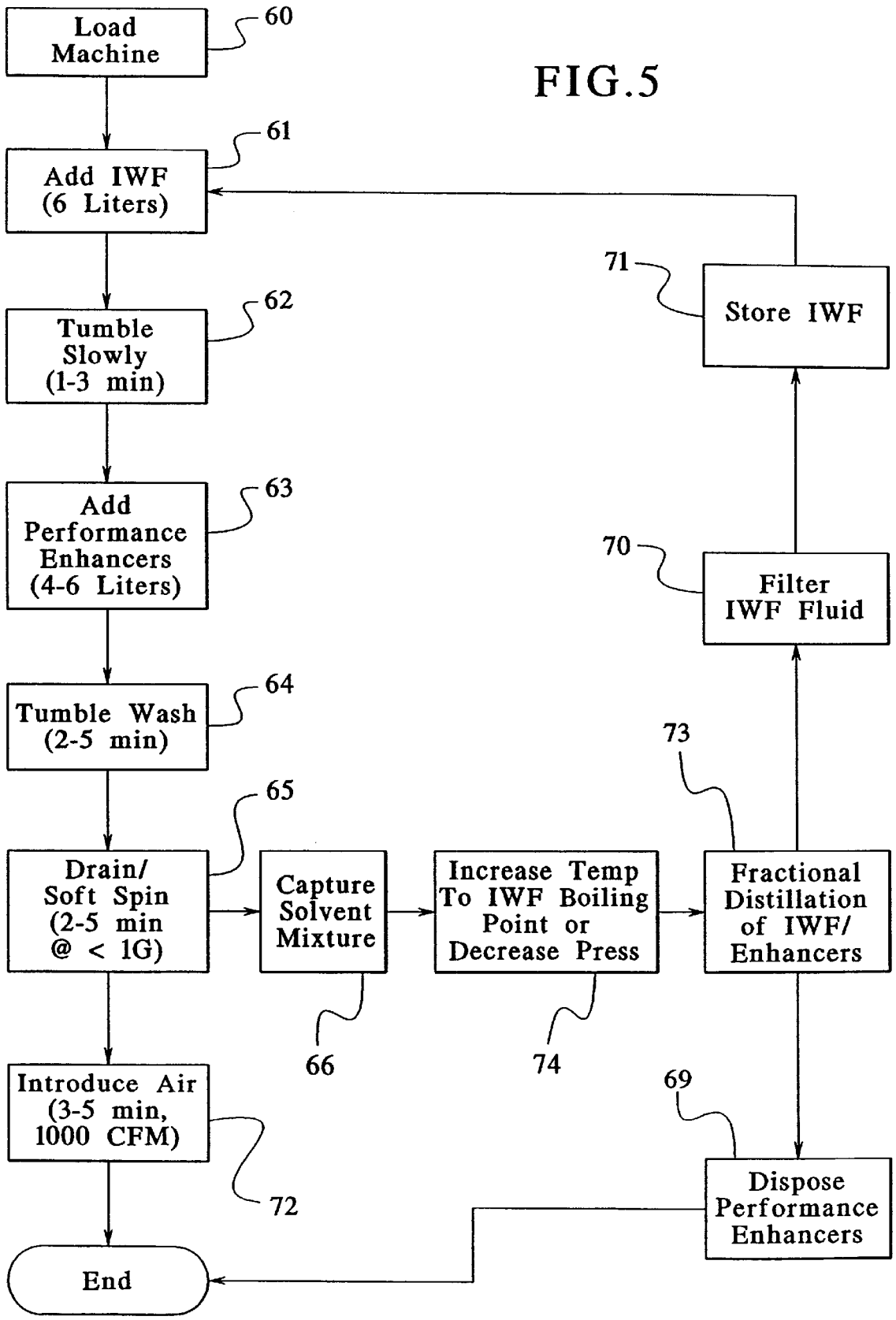
FIG. 5 is a flowchart illustrating another non-aqueous method of laundering a fabric load in accordance with the present invention.
Figure 8:
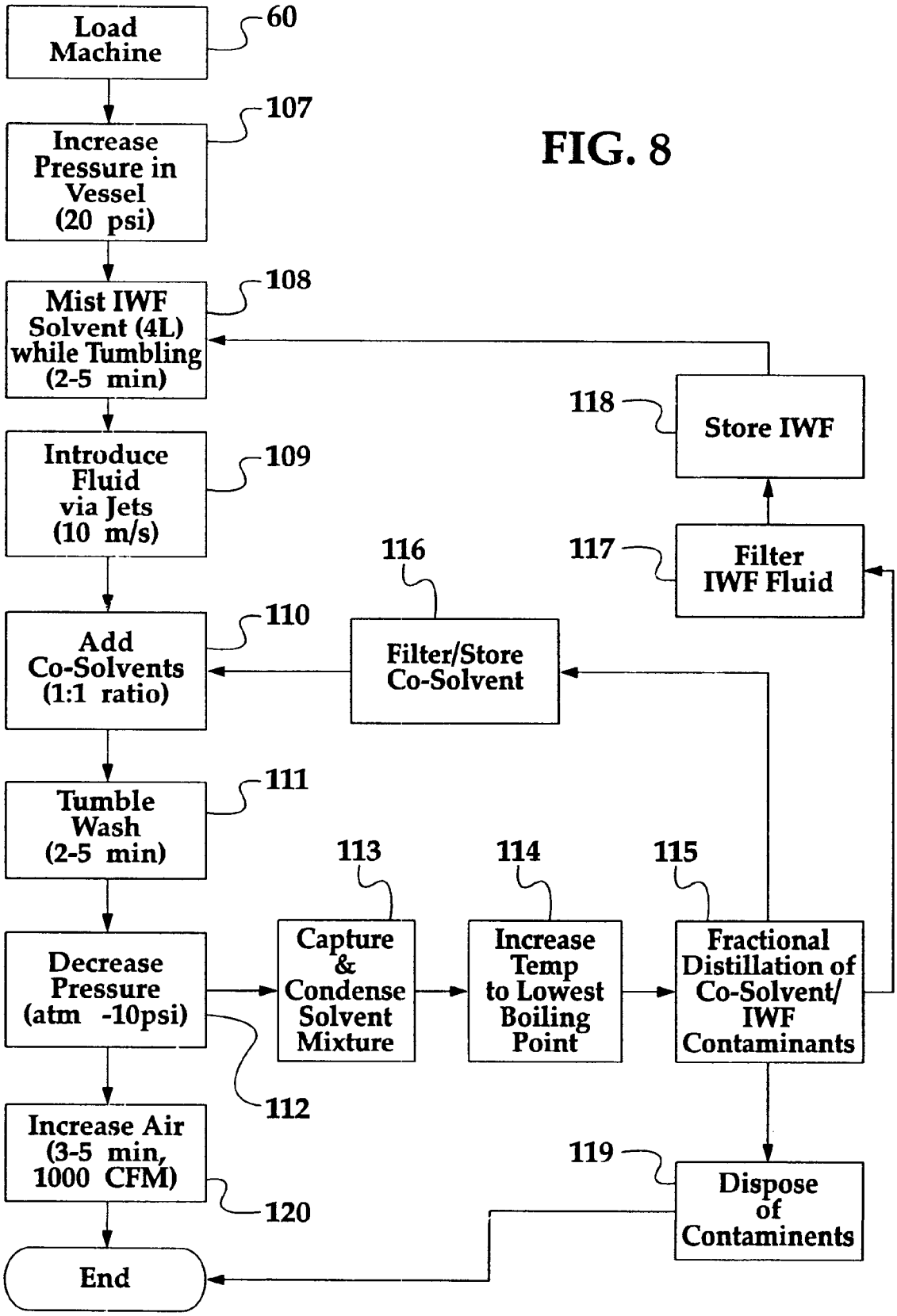
FIG. 8 is a flowchart illustrating another non-aqueous method of laundering a fabric load in accordance with the present invention.

An alternative method is illustrated in FIG. 5 which includes a different recovery and separation process than that of the method illustrated in FIG. 4. Instead of adding water to the IWF performance enhancer mixture at step 67 and performing a gravity separation at step 68 as illustrated in FIG. 4, the method illustrated in FIG. 5 practices a fractional distillation separation at step 73. Specifically, after the combination of the IWF and performance enhancers is captured at step 66, either the temperature of the mixture is increased to the IWF boiling point or the pressure is reduced to the point where the IWF begins to boil (or a combination of the two) at step 74. A fractional distillation of the IWF is performed at step 73, thereby separating the IWF from the performance enhancers so that the IWF can be filtered at step 70 and stored at step 71. The performance enhancers are disposed of at step 69.

Yet another method is illustrated in FIG. 6 which begins with the loading of the washing apparatus at step 60. After the fabric is loaded, the first step in the method is the addition of a solvent mixture comprising the IWF and a hydrophobic solvent at step 75. The hydrophobic solvent is responsible for removing oily soils and oil-based stains. The fabric load is tumbled for approximately 2–5 minutes at step 76. A combination drain and soft spin step is carried out at step 77 whereby the vast majority of the IWF and hydrophobic solvent mixture is collected at a separation and recovery center at step 78 where a gravity separation is carried out. Because the IWF is substantially heavier than the hydrophobic solvent, the two liquids are easily separated. The IWF is filtered at step 79 and stored at step 80. The hydrophobic solvent is filtered and stored at step 81. After the IWF and hydrophobic solvent are drained away from the fabric at step 77, a hydrophilic solvent is added at step 82 to remove water soluble material and particulates. A combination of the hydrophilic solvent and fabrics are tumbled for a time period ranging between 2 and 5 minutes at step 83. A combination drain and soft spin step is carried out at step 84. The bulk of the hydrophilic solvent is captured at step 85. Air is introduced into the washing chamber at step 86 which results in the production of solvent vapors which are condensed at step 87 and combined with the liquid solvent at step 88 where the temperature of the contaminated hydrophilic solvent is increased to its boiling point before being fractionally distilled at step 89. Preferably, a coil is used to condense the vapors at step 87 that has a sufficient length and temperature gradient to condense all fluids simultaneously. The hydrophilic solvent, less contaminants, is filtered and stored at step 90 while the contaminants are disposed of at step 91. It is anticipated that air introduced into the washing chamber at a rate of approximately 25 cubic feet per minute (CFM) will fully dry the fabric in a time period ranging from about three (3) minutes to about five (5) minutes, depending upon the specific hydrophilic solvent utilized.

Turning to FIG. 7, an additional method of washing fabric in accordance with the present invention is illustrated which again begins with the loading of the machine at step 60. A combination of IWF and hydrophilic solvent are added to the fabric disposed in the washing chamber at step 92. The fabric, IWF and hydrophilic solvent are then tumbled from a time period ranging from two (2) to about five (5) minutes, and most likely less than ten (10) minutes at step 93. A combination drain and soft spin process is carried out at step 94 which results in the collection of the IWF and hydrophilic solvent at step 95 where a gravity separation is performed. The hydrophilic solvent is filtered, stored and saved at step 96. The IWF is filtered at step 97 and stored at step 98 for re-use with the hydrophilic solvent during the next cycle. Hydrophobic solvent is then added to the fabric disposed within the washing chamber at step 99 before a tumbling or agitation step is carried out at step 100 which, again, lasts from about two (2) to about five (5) minutes. A combination drain and soft spin step is carried out at step 101. The hydrophobic solvent is captured at step 102, mixed with water at step 103 before a gravity separation is carried out at step 104. The hydrophobic solvent is filtered and stored for re-use at step 105 while the water and contaminants are disposed of at step 106. Air is introduced to the washing chamber at step 107 for drying purposes which will normally take from about three (3) to about five (5) minutes when the air is introduced at a rate between about 10 CFM and about 100 CFM.

Figure 15:
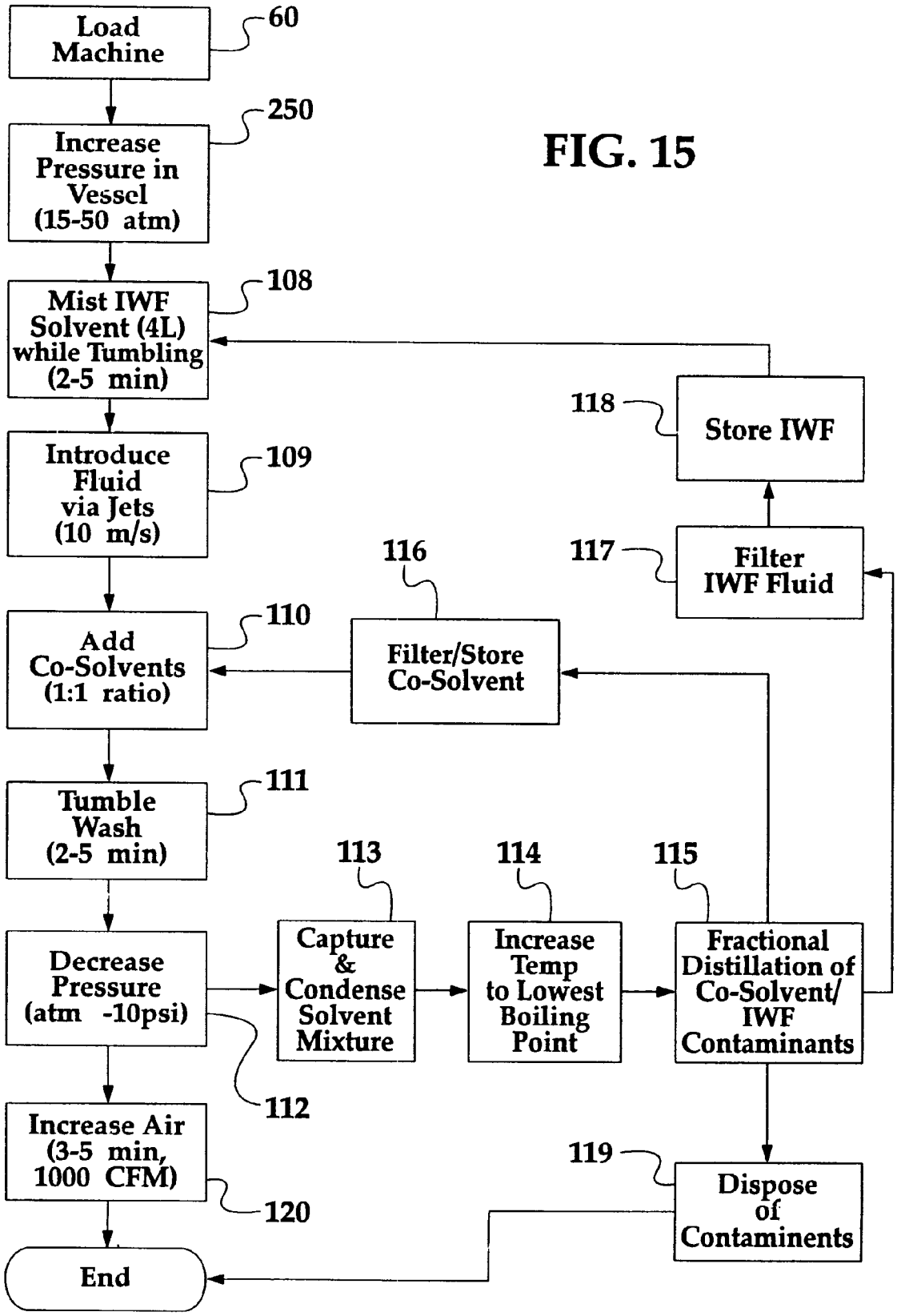
FIG. 15 is a flowchart illustrating another non-aqueous method of laundering a fabric load in accordance with the present invention.

Another method of practicing the present invention is illustrated in FIG. 15. The method begins with loading the washing chamber of a wash machine at step 60 by disposing a fabric load in an interior chamber of a wash container. In the method illustrated in FIG. 15, the washing chamber is pressurized to an elevated pressure of between 15 atm to about 50 atm at step 250. A wash liquor is delivered to the fabric load in the pressurized chamber in the form of a mist at step 108. The wash liquor is a substantially non-reactive, non-aqueous, non-oleophilic, apolar working fluid and at least one washing additive. In one embodiment, the at least one washing additive is added after the working fluid is added to the fabric load. The fabric load may be subjected to a series of spray jets which spray IWF onto the fabric load at step 109. Further, the wash liquor may be pumped from the washing chamber and resprayed onto the fabric load. Mechanical energy is then applied at step 111 to provide relative movement between the fabric load and the mist for a time sufficient to provide fabric cleaning. Relative movement may be provided by rotating the wash container about a horizontal axis. The pressure in the chamber is then decreased at step 112 to volatize the wash liquor. The volatilized wash liquor is removed from the chamber and fabric load at step 113. The volatilized wash liquor may be captured and condensed for reuse in step 113.

Another method of practicing the present invention is illustrated in FIG. 8 which again begins with the loading of the machine at step 60. In the method illustrated in FIG. 8, the washing chamber is pressurized to about 20 psi at step 107. A mist of IWF solvent is sprayed onto the fabric in the washing chamber at step 108 while the fabric is being tumbled during the rotation of the washing chamber. The purpose of adding the IWF in a mist form is to provide a greater surface area coverage with less IWF volume. The increase in pressure minimizes the amount of vaporization of the IWF. The fabric is then subjected to a series of spray jets which spray IWF onto the fabric at a rate of about 10 ml/s at step 109. The application of the IWF under pressure through the jets at step 109 helps to dislodge particulates and other insoluble material from the fabric. Co-solvents are added in a ratio of approximately 1:1 at step 110 before the combination of the fabric, IWF and co-solvents are tumbled at step 111 for a time period ranging from about two (2) minutes to about five (5) minutes. The pressure is decreased at step 112 and the IWF solvents and contaminants are drained off and captured at step 113. The temperature of the mixture is increased at step 114 to the lowest boiling point, either the IWF or co-solvent, and a fractional distillation is carried out at step 115. The co-solvent is filtered and stored at step 116 while the IWF is filtered at step 117 and stored at step 118. The contaminants are disposed of at step 119. Air is introduced into the washing chamber at step 120 at about 25 CFM for a time period ranging from about three (3) minutes to about five (5) minutes for drying purposes.

Figure 9:
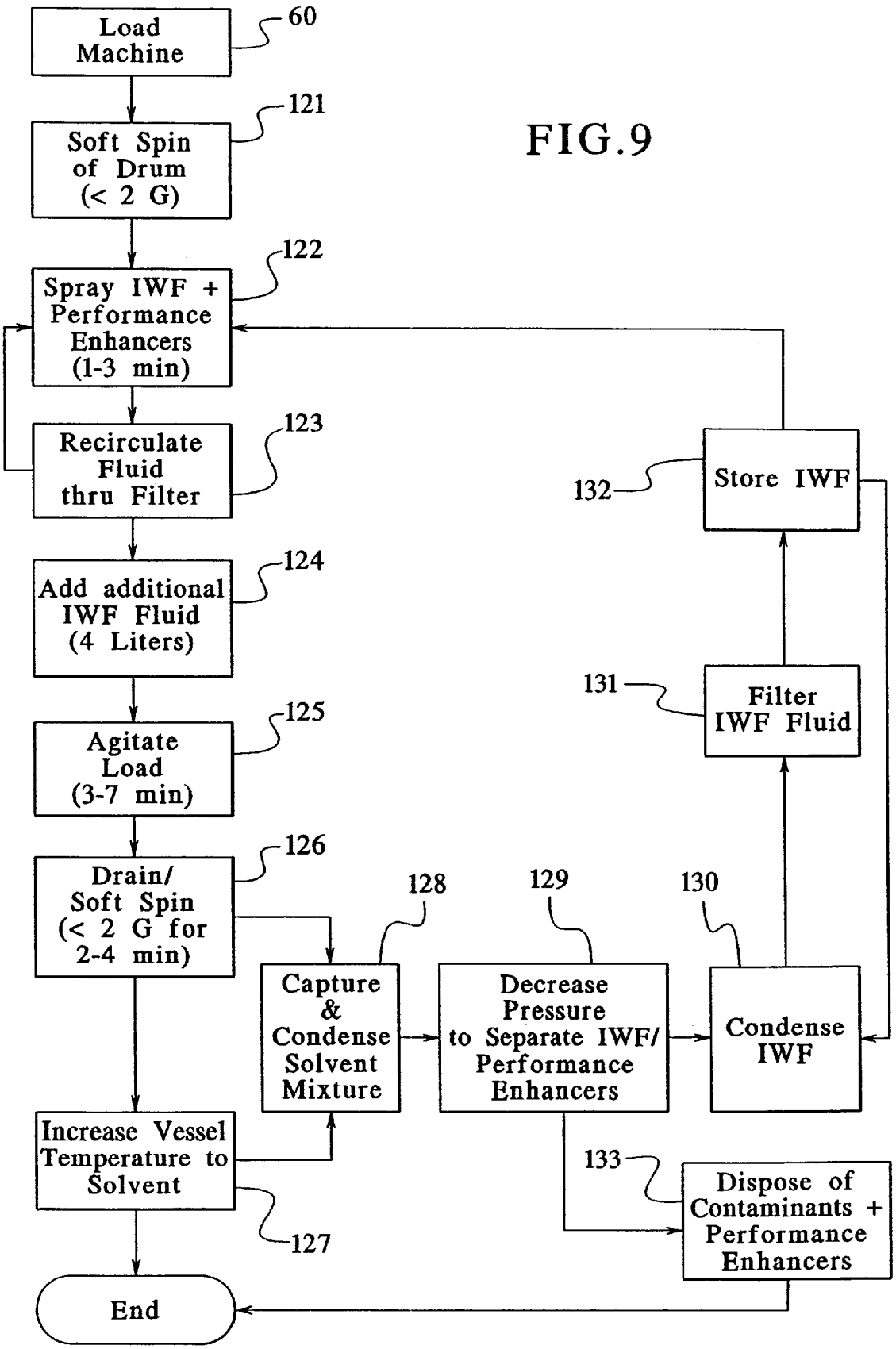
FIG. 9 is a flowchart illustrating another non-aqueous method of laundering a fabric load in accordance with the present invention.

Another method of carrying out the present invention is illustrated in FIG. 9. The fabric or clothes are loaded into the machine at step 60. The cycle begins with a soft spin of the load at step 121. IWF and performance enhancers are introduced into the washing chamber at step 122, preferably through a spray nozzle. The IWF and performance enhancers are collected and recirculated onto the fabrics at step 123. The spraying of the IWF and performance enhancers may last from a time period ranging from about one (1) minute to about three (3) minutes. Additional IWF is added at step 124 to provide a transport medium for the removal of oils and particulates. The load is agitated at step 125 for a time period ranging from about three (3) minutes to about seven (7) minutes. A combination drain and soft spin procedure is carried out at step 126 and the washing chamber is heated at step 127 to vaporize any remaining solvent on the fabric. The IWF and solvent is captured and condensed at step 128, the pressure is decreased at step 129 to separate the IWF from the performance enhancer. The IWF is condensed at step 130, filtered at step 131 and stored at step 132. The performance enhancers and contaminants are disposed of at step 133.

Figure 10:
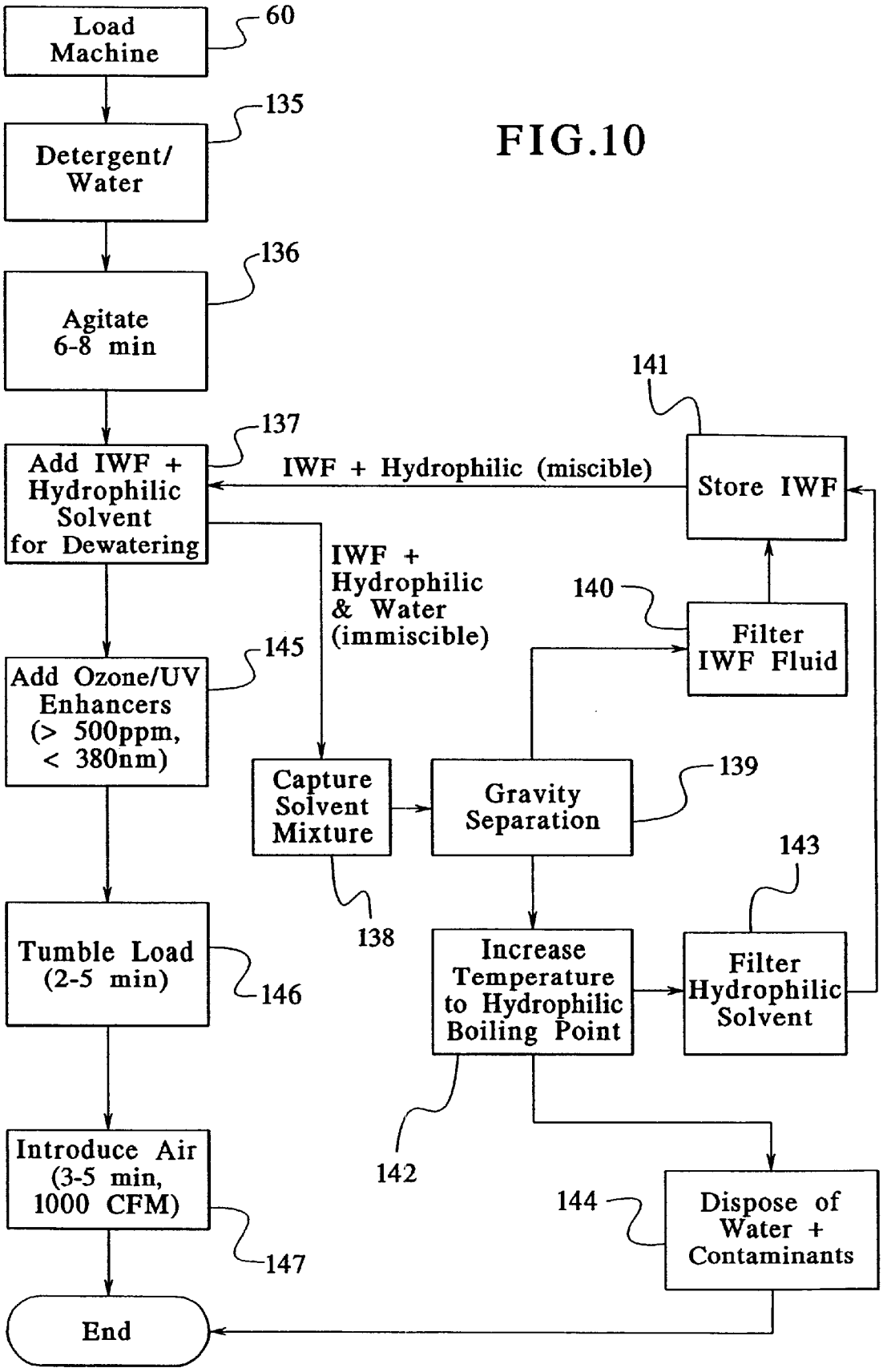
FIG. 10 is a flowchart illustrating another non-aqueous method of laundering a fabric load in accordance with the present invention.

Another method of practicing the present invention is illustrated in FIG. 10. The machine is loaded with fabric at step 60. A combination of detergent and water is introduced into the washing chamber at step 135. The fabric, detergent and water combination is agitated for a time period ranging from about six (6) minutes to about eight (8) minutes at step 136. The IWF and at least one hydrophilic solvent are added at step 137 for removing the water and transporting the particulates from the load. The IWF and hydrophilic solvent are miscible prior to the addition, however, in the presence of water, they become immiscible and therefore, upon capture of the IWF hydrophilic solvent and water at step 138, the IWF can be separated using a gravity separation technique at step 139. The IWF is filtered at step 140 and stored at step 141 where it is combined with the recovered hydrophilic solvent. The hydrophilic solvent is recovered by increasing water/hydrophilic solvent mixture at step 142 to boil off the hydrophilic solvent at step 143 leaving the water behind. The water and contaminants are disposed of at step 144. The hydrophilic solvent is then re-combined with the IWF at step 141.

Still referring to FIG. 10, ozone or ultraviolet (UV) radiation is applied to the fabric at step 145 to assist in the bleaching and/or disinfecting and/or odor removal of the fabric load. The ozone concentration should be greater than 500 ppm and the UV wavelength should fall in a range between 160–380 nm. As indicated at step 146, the load should be tumbling during the application of the ozone and/or UV. Air is then introduced for drying purposes at step 147.

Figure 11:
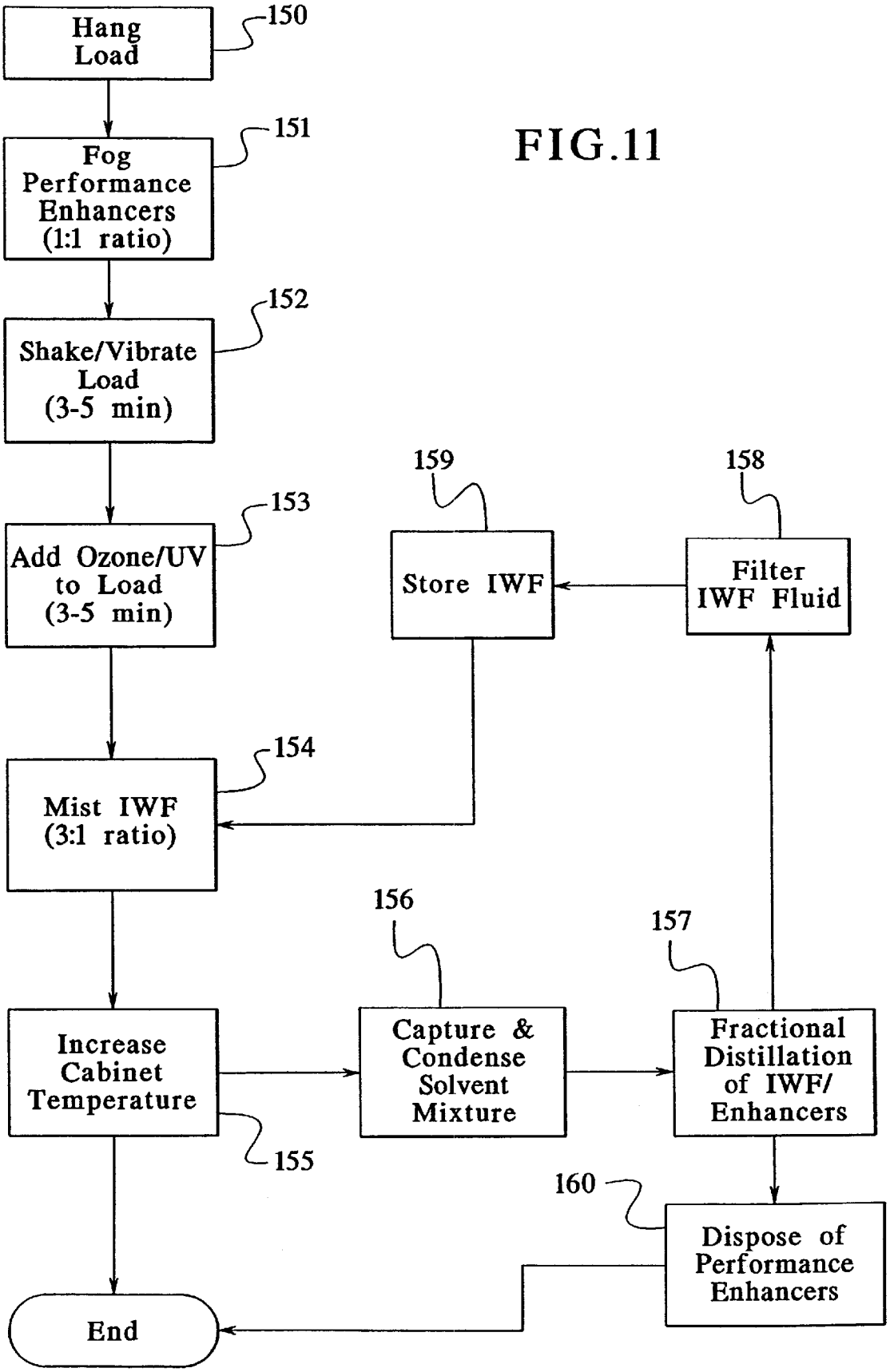
FIG. 11 is a flowchart illustrating another non-aqueous method of laundering a fabric load in accordance with the present invention.

Another method of practicing the present invention is illustrated in FIG. 11. The fabric load, or clothing, is hung at step 150 within a sealed chamber. Performance enhancers are "fogged" into the chamber in a volume weight about equal to that of the fabric load at step 151. Instead of a typical agitation process, the clothing is shaken or vibrated for a time period ranging from about three (3) minutes to about five (5) minutes. Ozone and/or UV may be applied to the clothing in appropriate amounts for stain removal and/or odor control at step 153. IWF is introduced into the vessel or cabinet at step 154 in a mist form and in an amount of about 11/3 the weight of the fabric and performance enhancers. The cabinet temperature is then increased at step 155 to vaporize the performance enhancers and IWF. The performance enhancers and IWF mixture is captured at step 156 and fractionally distilled at step 157. The IWF is filtered at step 158 and stored at step 159. The performance enhancers are disposed of at step 160.

Figure 12:
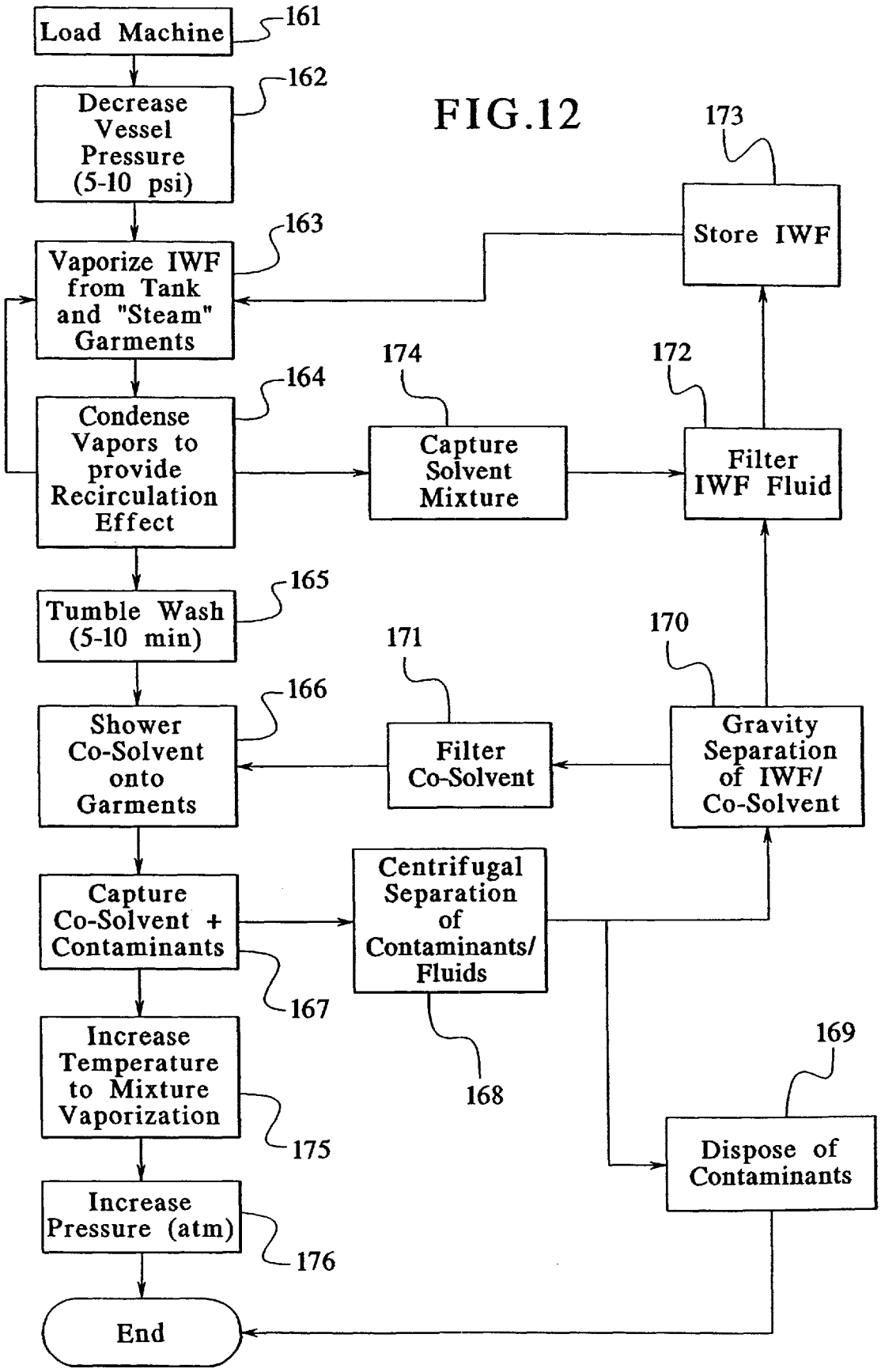
FIG. 12 is a flowchart illustrating another non-aqueous method of laundering a fabric load in accordance with the present invention.

Yet another method of practicing the present invention is illustrated in FIG. 12. The machine is loaded at step 161 and the vessel pressure is reduced to about 10 psi or below at step 162. As the IWF is being added at step 163, the temperature of the vessel is increased to approximately 30° C. which results in a steaming of the fabric or clothing with the IWF. The IWF vapors are condensed at step 164 preferably by a condenser disposed at the top of the machine which then re-introduces the condensed vapors back into the washing chamber for a time period ranging from about five (5) minutes to about ten (10) minutes, preferably while the clothes are being tumbled (see step 165). The clothes are then showered with a co-solvent at step 166 to remove particulates and oily soils. The co-solvent, IWF and contaminants are captured at step 167, separated by centrifugal separation at step 168 before the contaminants are disposed of at step 169. The co-solvent and IWF are separated at step 170 by gravity separation before the co-solvent is filtered at step 171. The showering of the co-solvent onto the garments may be repeated at step 166, several times if necessary. The IWF is filtered at step 172 and stored at step 173. The IWF that has been condensed at step 164, may also be captured at step 174 and filtered by the common filter at step 172 and stored in the IWF storage vessel at step 173. The temperature of the vessel or chamber is increased at step 175 to fully dry the clothing before the pressure is increased to atmospheric pressure at step 176.

As noted above, one family of chemicals particularly suited for use as IWFs in the methods and apparatuses of the present invention are "fluoroinert" liquids. Fluoroinert liquids have unusual properties which make them particularly useful as IWFs. Specifically, the liquids are clear, colorless, odorless and non-flammable. Fluoroinerts differ from one another primarily in boiling points and pour points. Boiling points range from a about 56° C. to about 253° C. The pour points typically range from about 30° C. to about −115° C.

All of the known fluoroinert liquids possess high densities, low viscosities, low pour points and low surface tensions. Specifically, the surface tensions typically range from 12 to 18 dynes/cm$^2$ as compared to 72 dynes/cm$^2$ for water. Fluoroinert liquids typically have a solubility in water ranging from 7 ppm to 13 ppm. The viscosity of fluoroinerts typically ranges from 0.4 centistokes to 50 centistokes. Fluoroinerts also have low KB values, otherwise known as kauri-butanol values. The KB value is used as a measure of solvent power of hydrocarbon solvents. Fluoroinerts have little or no solvency.

In addition to fluoroinerts, hydrofluoroethers, perfluorocarbons and similarly fluorinated hydrocarbons can be used as an IWF in the methods and apparatuses of the present invention. These additional working fluids are suitable due to their low surface tension, low vapor pressure and high fluid density.

In the above methods, the cleaning agents or performance enhancers may be applied to the fabric by way of an immersion process, misting, foaming, fogging, the application of a gel to the fabric, or the mixture of a solid powder or solid particulates in the IWF. The machine loading of the fabrics or clothes may be a bulk or batch process, a continuous process or, as noted above with respect to FIG. 11, the clothes may be hung in a sealable chamber.

The removal of a film-type soil may be performed by vapor degreasing, increasing the temperature within the washing chamber, increasing the pH within the washing chamber, solubilization of the film-type soil, the application of enzymes to the film-type soil, the application of performance enhancers that break up the surface tension of the film-type soil or performance enhancers that increase the viscosity of the IWF and therefore increase the effectiveness of mechanical agitation in removing the film-type soil.

As indicated above in FIGS. 4–12 and 15, tumbling of the fabric, IWF and any additives including performance enhancers and co-solvents in the washing chamber is a suitable method of transferring mass, i.e. soils, from the fabric to the IWF and/or co-solvent. Other methods of mass transfer include rinsing, centrifugation, shaking, wiping, dumping, mixing and wave generation.

Water soluble stains may be removed in accordance with the present invention by using water as a co-solvent, using performance enhancers to increase the solubility of the stain in the IWF, shifting the pH of the mixture in the washing chamber, shifting the ionic strength of the mixing chamber and the washing chamber, increasing or decreasing the conductivity of the mixture in the washing chamber, and increasing or decreasing the polarity of the mixture in the washing chamber.

Stains consisting primarily of protein may be removed in accordance with the present invention with the use of enzymes, performance enhancers that cause the protein to swell, performance enhancers that cleave the protein, soaking the fabric in the washing chamber in IWF alone or IWF in combination with the performance enhancer and the use of low temperature tumbling and/or soaking.

Stains consisting primarily of carbohydrates may be removed in accordance with the present invention by hydrating the stain by using water as a co-solvent, the use of enzymes, a shifting of the pH in the washing chamber, an increase of the temperature in the washing chamber and performance enhancers that increase the solubility of the carbohydrate stain in the IWF and/or co-solvent. Bleaching strategies may also be employed in accordance with the present invention. Bleachable stains may be removed by oxidation, reduction, the use of enzymes, the use of performance enhancers to cleave color bonds and the pH may also be shifted within the washing chamber to remove a bleachable stain.

Surfactants may be removed from the fabrics in accordance with the present invention through use of dilution, force convection, vaporization, a solvent that is miscible with the surfactant, neutralization or phase inversion techniques.

As indicated above in FIGS. 4–12, tumbling of the fabric, IWF and any additives including performance enhancers and co-solvents in the washing chamber is a suitable method of transferring mass, i.e. soils, from the fabric to the IWF and/or co-solvent. Other methods of mass transfer include rinsing, centrifugation, shaking, wiping, dumping, mixing and wave generation.

Also, as indicated above in FIGS. 4–12 and 15, the application of air is a suitable method of dehydration or drying the fabric. Other methods of drying may employ centrifugation, liquid extraction, the application of a vacuum, the application of forced heated air, the application of pressurized air, simply allowing gravity to draw the IWF away from the fabric and the application of a moisture absorbing material.

As indicated above in FIGS. 4–12 and 15, the IWF and co-solvents may be recovered through the use of gravity separation, filtration and centrifugation. In addition, de-watering, scrubbing, vaporization, phase inversion and the application of an induced electrical field may be used in recovery and purification of the IWF and co-solvents.

As noted above, the tumbling, agitation or nutation may be accomplished by generally rotating the washing chamber about a horizontal axis or about a vertical axis. An example of a washing apparatus having a generally horizontally disposed axis of rotation is set forth in U.S. Pat. No. 4,759,202, which is incorporated herein by reference. One example of a washing apparatus having a generally vertical axis is set forth in U.S. Pat. No. 5,460,018, which is also incorporated herein by reference.

Figure 14:
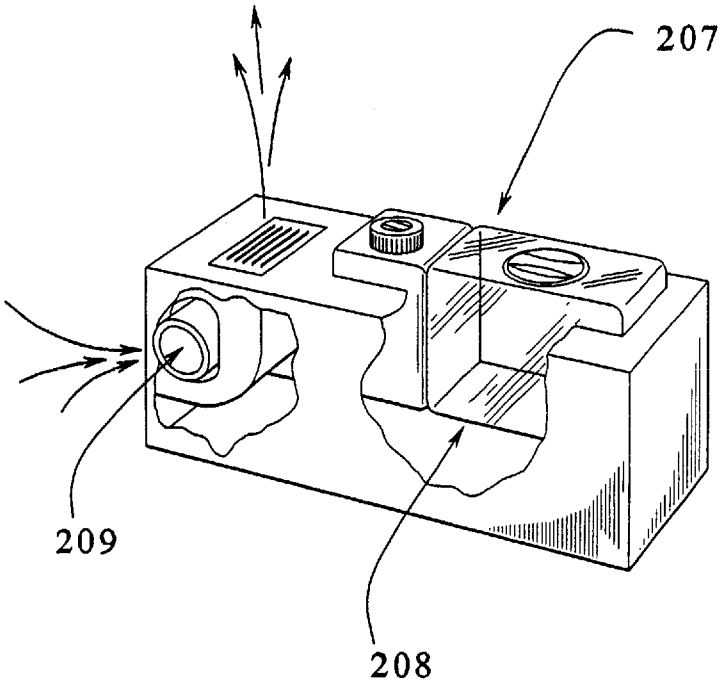
FIG. 14 is a partial view of the washing apparatus shown in FIG. 13.
Figure 13:
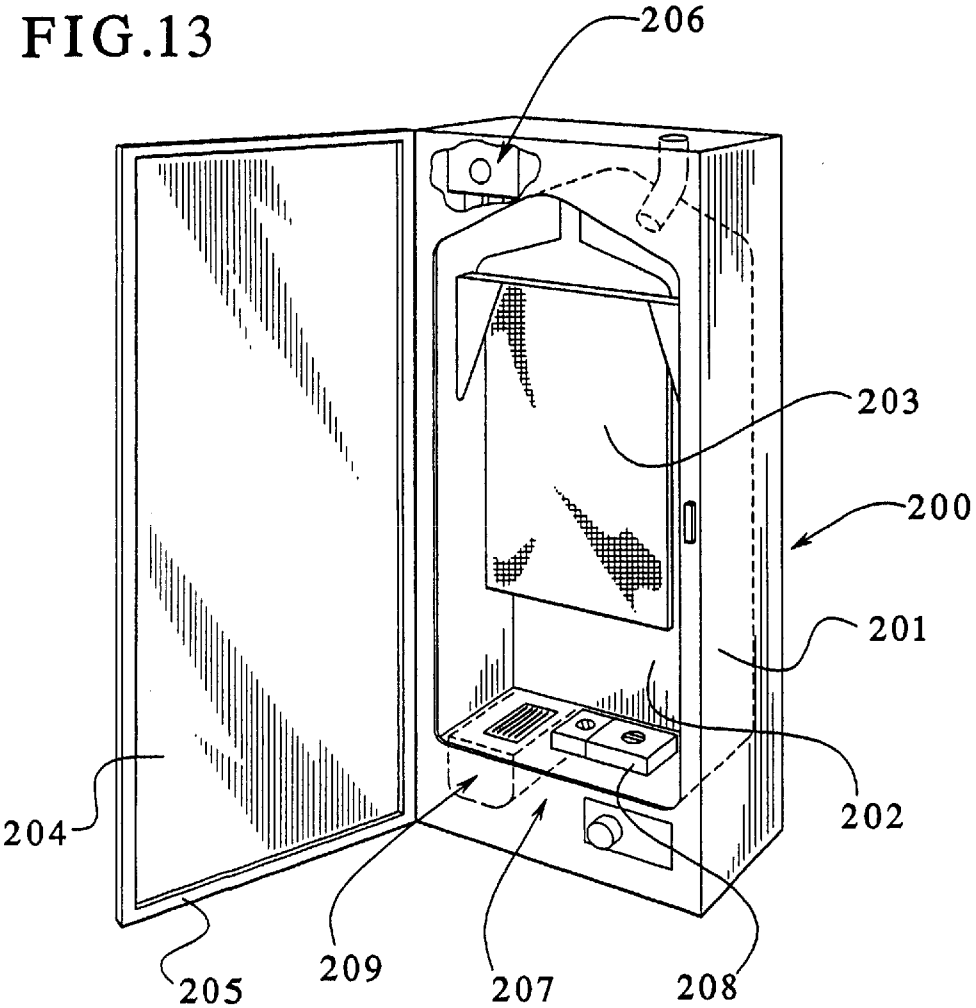
FIG. 13 is a perspective view of another washing apparatus made in accordance with the present invention.

An apparatus that can be used to carry out the method set forth in FIG. 11 is further illustrated in FIGS. 13 and 14. Specifically, the apparatus 200 includes a main housing or cabinet 201. The cabinet 201 forms an interior region 202 for hanging garments 203. The door 204 is equipped with a gasket 205 for sealing the interface between the door 204 and the main cabinet 201.

The cabinet 201 includes an upper assembly 206 which can include a means for shaking or vibrating the garments 203 (see step 152 in FIG. 11) as well as adding ozone/UV or applying a mist to the garments 203 (see steps 153, 154 in FIG. 11). The cabinet 201 also includes a lower housing assembly 207 which can support a moisture or misting generator 208 and a heater 209 for increasing the temperature inside the cabinet 201. The condenser, distillation apparatus, filter, storage tank and disposal means (see steps 156–160 in FIG. 11) may be attached to the cabinet 201 and housed in a manner similar to the IWF storage unit shown at 12 in FIGS. 2 and 3.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An automatic washing apparatus to dry launder a fabric load, the apparatus comprising:

(a) a sealed wash chamber;

(b) means for pressurizing the wash chamber to pressures greater than 1 atm;

(c) means for dispensing a wash liquor into the wash chamber;

(d) means for agitating the fabric load in the wash chamber, to provide for flexure of the fabrics in the fabric load;

(e) means for substantially removing the wash liquor from the wash chamber; and (f) means for reducing the pressure in the wash chamber to a pressure equal to or less than 1 atm.

2. The automatic washing apparatus as defined in claim 1, wherein the dispensing means comprises a means for forming a mist.

3. The automatic washing apparatus as defined in claim 1, further comprising a wash basket disposed in the wash chamber for receiving the fabric load.

4. The automatic washing apparatus as defined in claim 1, wherein the wash liquor has a vapor pressure less than the vapor pressure of water.

5. The automatic washing apparatus as defined in claim 1, wherein the wash liquor comprises a working fluid and at least one washing additive.

6. The automatic washing apparatus as defined in claim 5, wherein the dispensing means comprises means for mixing the working fluid with the at least one washing additive to form the wash liquor.

7. The automatic washing apparatus as defined in claim 5, wherein the dispensing means includes means for sequentially dispensing the working fluid and the at least one washing additive.

8. The automatic washing apparatus as defined in claim 5, wherein the dispensing means includes means for sequentially dispensing the at least one washing additive and the working fluid.

9. The automatic washing apparatus as defined in claim 5, further comprising a storage unit for storing the working fluid.

10. The automatic washing apparatus as defined in claim 9, further comprising means for separating the working fluid from the at least one washing additive.

11. The automatic washing apparatus as defined in claim 10, wherein the separating means separates the working fluid from the at least one washing additive by gravity separation.

12. The automatic washing apparatus as defined in claim 10, wherein the separating means comprises a distillation apparatus for separating the working fluid from the at least one washing additive by distillation.

13. The automatic washing apparatus as defined in claim 10, wherein the separating means comprises a filter.

14. The automatic washing apparatus as defined in claim 10, further comprising means for transferring the separated working fluid to the storage unit.

15. The automatic washing apparatus as defined in claim 1, wherein the pressurizing means pressurizes the wash chamber to pressures of from about 5 atm to about 50 atm.

16. The automatic washing apparatus as defined in claim 1, further comprising a particle trap disposed adjacent to the wash chamber.

17. An automatic washing apparatus to dry launder a fabric load, the apparatus comprising:

(a) a sealed wash chamber having a rotatable wash basket having at least one perforation;

(b) means for pressurizing the wash chamber to pressures greater than 1 atm;

(c) means for dispensing a wash liquor into the wash chamber;

(d) means for agitating the fabric load in the wash chamber, to provide for flexure of the fabrics in the fabric load;

(e) means for substantially removing the wash liquor from the wash chamber wherein the wash liquor is removed via a fluid path through the wash basket perforation; and (f) means for reducing the pressure in the wash chamber to a pressure equal to or less than 1 atm.

18. The apparatus of claim 17, (g) wherein the dispensing means comprises a means for forming a mist;

(h) wherein the pressurizing means pressurizes the wash chamber to pressures of from about 5 atm to about 50 atm; and (i) wherein the means for agitating further includes a horizontal axis or vertical axis agitation means.

* * * * *